US012480531B2

(12) United States Patent
Chen et al.

(10) Patent No.: US 12,480,531 B2
(45) Date of Patent: Nov. 25, 2025

(54) BELL MOUTH AND FAN UNIT

(71) Applicant: DAIKIN INDUSTRIES, LTD, Osaka (JP)

(72) Inventors: Zuozhou Chen, Osaka (JP); Ryusuke Otaguro, Osaka (JP); Anan Takada, Osaka (JP); Kaname Maruyama, Osaka (JP)

(73) Assignee: DAIKIN INDUSTRIES, LTD, Osaka (JP)

( * ) Notice: Subject to any disclaimer, the term of this patent is extended or adjusted under 35 U.S.C. 154(b) by 0 days.

(21) Appl. No.: 18/851,035

(22) PCT Filed: Mar. 29, 2023

(86) PCT No.: PCT/JP2023/012735
§ 371 (c)(1),
(2) Date: Sep. 25, 2024

(87) PCT Pub. No.: WO2023/190643
PCT Pub. Date: Oct. 5, 2023

(65) Prior Publication Data

US 2025/0257743 A1 Aug. 14, 2025

(30) Foreign Application Priority Data

Mar. 31, 2022 (JP) ..... 2022-060651

(51) Int. Cl.
*F04D 29/66* (2006.01)
*F04D 19/00* (2006.01)
*F04D 29/54* (2006.01)

(52) U.S. Cl.
CPC ..... *F04D 29/667* (2013.01); *F04D 19/002* (2013.01); *F04D 29/541* (2013.01)

(58) Field of Classification Search
CPC .... F04D 29/664; F04D 29/667; F04D 19/002; F04D 29/541
See application file for complete search history.

(56) References Cited

U.S. PATENT DOCUMENTS 6,450,760 B1 * 9/2002 Furukawa ..... F04D 29/384 416/189
12,152,600 B2 * 11/2024 Teramoto ..... F04D 29/288
(Continued)

FOREIGN PATENT DOCUMENTS

JP 48-54305 U 7/1973
JP 62-276298 A 12/1987
(Continued)

OTHER PUBLICATIONS

International Preliminary Report of corresponding PCT Application No. PCT/JP2023/012735 dated Sep. 24, 2024.
(Continued)

*Primary Examiner* — Sabbir Hasan
(74) *Attorney, Agent, or Firm* — GLOBAL IP COUNSELORS, LLP

(57) ABSTRACT

A bell mouth includes a circumferential wall, and a pressure changing component permeable portion arranged in the circumferential wall at a location where a separated distance from an axial fan is minimal. A fan unit includes the bell mouth, an axial fan, and a case that accommodates the axial fan and the bell mouth. The fan unit has an air layer between the circumferential wall of the bell mouth and the case.

13 Claims, 3 Drawing Sheets

(56) References Cited

U.S. PATENT DOCUMENTS

| | | | |
|---|---|---|---|
| 2002/0015640 | A1 | 2/2002 | Nishiyama et al. |
| 2020/0149535 | A1 | 5/2020 | Takemoto et al. |

FOREIGN PATENT DOCUMENTS

| | | | | |
|---|---|---|---|---|
| JP | S62276298 | A | * | 12/1987 |
| JP | 6-25597 | U | | 4/1994 |
| JP | 2001-152852 | A | | 6/2001 |
| JP | 2002-39118 | A | | 2/2002 |
| JP | 2007-218150 | A | | 8/2007 |

OTHER PUBLICATIONS

International Search Report of corresponding PCT Application No. PCT/JP2023/012735 dated Jun. 13, 2023.
International Preliminary Report of corresponding PCT Application No. PCT/JP2023/011559 dated Sep. 24, 2024.
European Search Report of corresponding EP Application No. 23 78 0652.6 dated Jun. 3, 2025.

* cited by examiner

BELL MOUTH AND FAN UNIT

CROSS-REFERENCE TO RELATED APPLICATIONS

This application is a U.S. National stage application of PCT/JP2023/012735 Filed on Mar. 29, 2023. This U.S. National stage application claims priority under 35 U.S.C. § 119 (a) to Japanese Patent Application Nos. 2022-060651, filed in Japan on Mar. 31, 2022, the entire contents of which are hereby incorporated herein by reference.

BACKGROUND

Technical Field

The present disclosure relates to a bell mouth and a fan unit.

Background Information

Microfilm of Japanese Utility Model Application No. 04-68593 (Japanese Laid-Open Utility Model Application No 06-25597) describes a known technique related to a fan shroud of an axial fan. Microfilm of Japanese Utility Model Application No. 04-68593 (Japanese Laid-Open Utility Model Application No 06-25597) describes that the fan shroud is entirely or partly made of a through-pore material such as plastic or sintered aluminum alloy. When the blades of the axial fan approach the fan shroud, the pressure of the flowing air changes in a sudden manner and produces impulsive noise that is absorbed by the through-pore material. This reduces NZ noise, which is blade pitch noise.

SUMMARY

Technical Problem

In addition to the NZ noise, it is desired that the bell mouth of the axial fan reduces wind noise generated at the surface of the bell mouth.

A bell mouth that solves the above problem includes a circumferential wall and pressure changing component permeable portions in the circumferential wall at a location where a separated distance from an axial fan is minimal.

With this structure, when the pressure changes in the air passing by the axial fan, the air in the vicinity of the circumferential wall readily passes through the pressure changing component permeable portions. Thus, the change in pressure is reduced. This mitigates surface vortices generated on the circumferential wall and suitably reduces wind noise caused by the surface vortices.

In the above bell mouth, the pressure changing component permeable portions include pores connecting the opposite sides of the circumferential wall in the thickness direction. The pores have an average pore diameter of 1000 μm or less.

When the pressure changes, this structure allows the air in the vicinity of the circumferential wall to pass through the pressure changing component permeable portions, and excessive air does not pass through the pressure changing component permeable portions. This reduces loss in the air that passes through the axial fan.

In the above bell mouth, the pressure changing component permeable portions include pores connecting the opposite sides of the circumferential wall in the thickness direction. The pores have an average pore diameter of 700 μm or less.

This structure allows the air in the vicinity of the circumferential wall to pass through the pressure changing component permeable portions, and further reduces loss in the air that passes through the axial fan.

In the above bell mouth, the pressure changing component permeable portions are arranged at intervals in the circumferential direction of the circumferential wall.

This structure allows for the arrangement of the pressure changing component permeable portions, while maintaining the strength of the bell mouth in a preferred manner.

In the above bell mouth, the thickness of the circumferential wall is 1 mm or greater.

This structure ensures that air passes through the pressure changing component permeable portions over a flow path length. Thus, a function for allowing for the permeable of the air in the vicinity of the circumferential wall through the pressure changing component permeable portions and a function for limiting the permeable of excessive air through the pressure changing component permeable portions are both obtained.

In the above bell mouth, the thickness of the circumferential wall is 10 mm or less.

With this structure, the thickness of the circumferential wall is relatively thin. Thus, the cost for manufacturing the bell mouth is reduced.

A fan unit that solves the above problem includes the axial fan, the bell mouth, and a case, which accommodates the axial fan and the bell mouth. Further, in the fan unit, an air layer extends between the circumferential wall of the bell mouth and the case.

With this structure, air that has passed through the pressure changing component permeable portions is released to the air layer. This readily reduces pressure changes in the pressure changing component permeable portions.

DESCRIPTION OF EMBODIMENTS

Fan Unit

A fan unit 10 will now be described with reference to FIG. 1.

Figure 1:
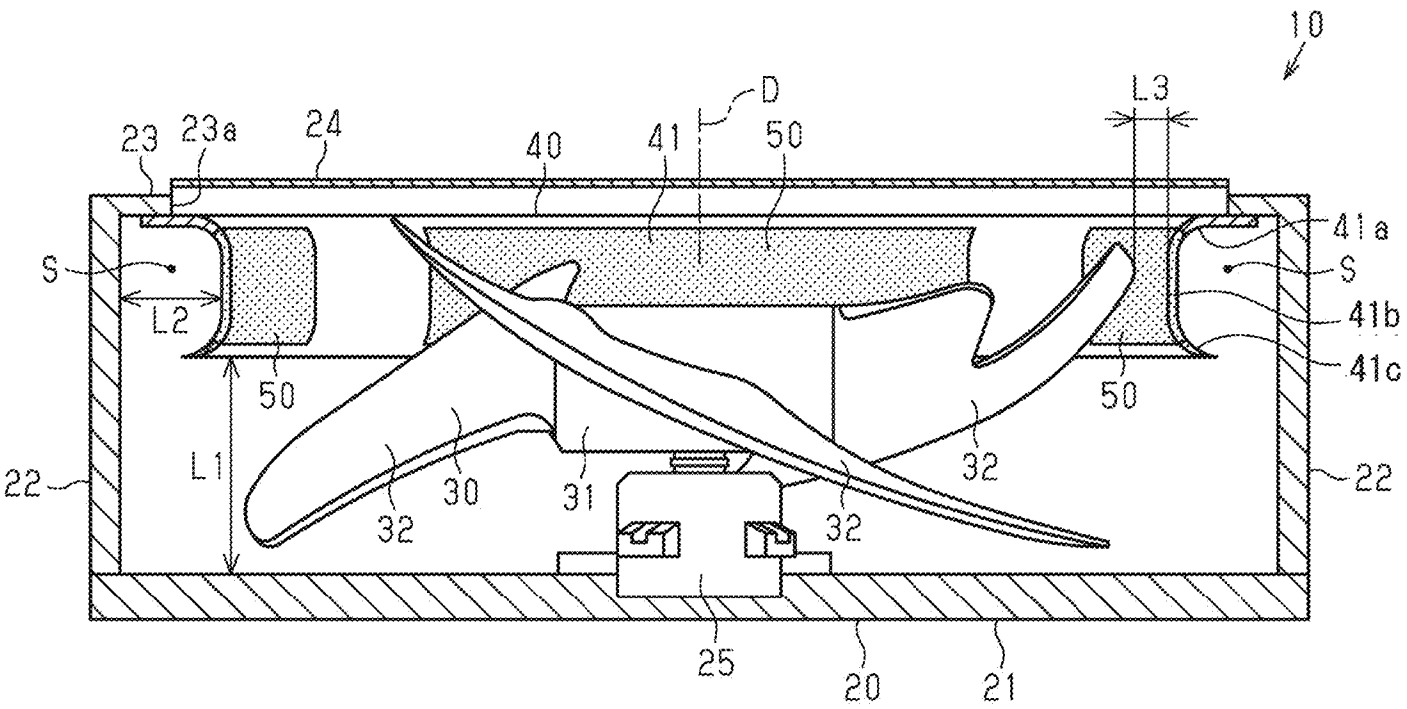
FIG. 1 is a partial cross-sectional view of a fan unit.

As shown in FIG. 1, the fan unit 10 includes a case 20, an axial fan 30, and a bell mouth 40. The case 20 includes a bottom wall 21, having the form of a rectangular plate, and side walls 22, each extending from the sides of the bottom wall 21 in the thickness direction of the bottom wall 21. The case 20 also includes a top wall 23 on the ends of the side walls 22 opposite to the bottom wall 21. The top wall 23 includes a circular opening 23*a*. A netted outlet grille 24 is attached to the opening 23*a* in the top wall 23. An axial fan motor 25 is attached to the bottom wall 21.

The axial fan 30 and the bell mouth 40 are accommodated in the case 20.

The axial fan 30 includes a rotary shaft 31 and three blades 32 connected to the rotary shaft 31. The axial fan 30 is accommodated in the case 20 in a state in which the rotary shaft 31 is connected to the axial fan motor 25.

The bell mouth 40 is accommodated in the case and attached to the edge of the opening 23*a* in the top wall 23.

As shown in FIG. 1, the fan unit 10 is configured so that air drawn through an inlet (not shown) of the case 20 is blown out of the opening 23*a* by the rotation of the blades 32 of the axial fan 30. The opening 23*a* of the case 20 is also referred to as an outlet.

The fan unit 10 is used as an air blower. Specifically, the fan unit 10 is used as the outdoor unit of an air conditioner for cooling or heating an indoor space such as an office.

Bell Mouth

A bell mouth 40 will now be described with reference to FIGS. 1 and 2.

The bell mouth 40 includes a circumferential wall 41 that is annular in plan view. The circumferential wall 41 includes an outlet portion 41*a*, a tubular portion 41*b*, and an inlet portion 41*c*.

Figure 2:
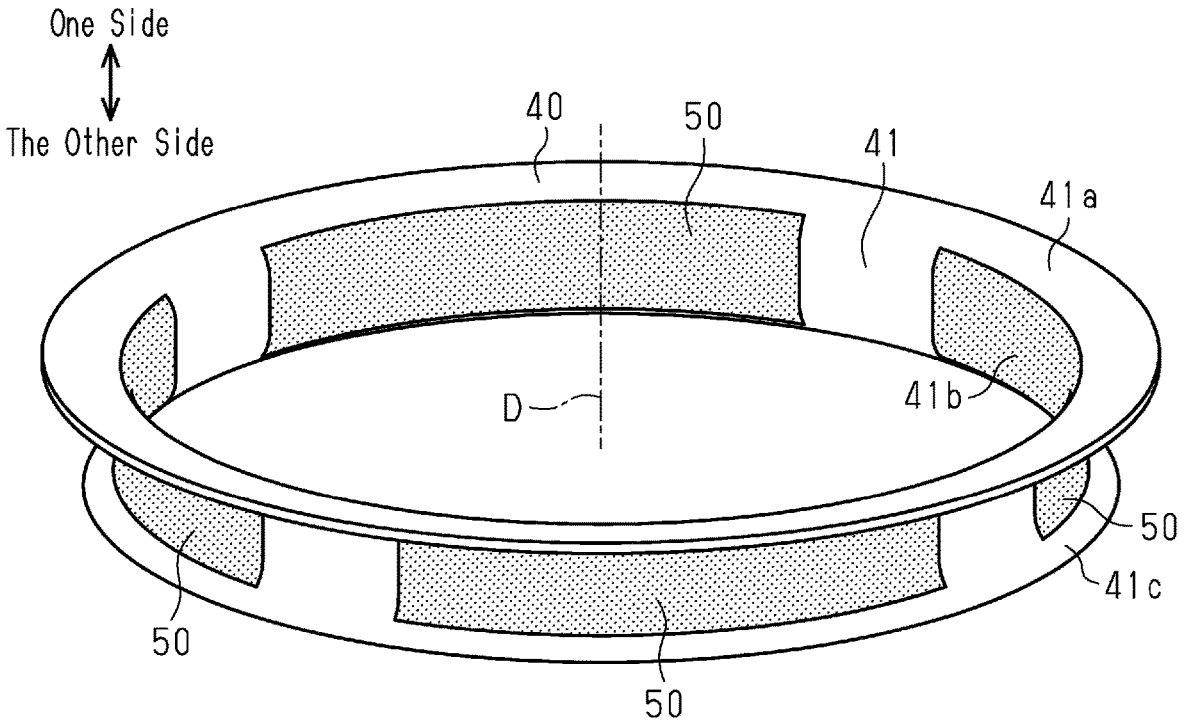
FIG. 2 is a perspective view of a bell mouth.

As shown in FIG. 2, the outlet portion 41*a* is located at the end of the bell mouth 40 located at one side of the bell mouth 40 in a direction parallel to the axis D of the bell mouth 40. The outlet portion 41*a* is curved so that the inner diameter decreases toward the end at the other side of the bell mouth 40 in the direction parallel to the axis D of the bell mouth 40.

The tubular portion 41*b* extends continuously from the end of the outlet portion 41*a* at the other side of the outlet portion 41*a* toward the other side of the bell mouth 40. The inner diameter of the tubular portion 41*b* is fixed. The axis of the tubular portion 41*b* coincides with the axis D of the bell mouth 40.

The inlet portion 41*c* extends continuously from the end of the tubular portion 41*b* at the other side. The inlet portion 41*c* is curved so that the inner diameter increases from the end of the tubular portion 41*b* at the other side of the tubular portion 41*b* toward the other side of the bell mouth 40.

The thickness of the circumferential wall 41 is not particularly limited. For example, the thickness is preferably 1 mm or greater, and more preferably, 2 mm or greater. Further, the thickness is preferably 10 mm or less, and more preferably, 5 mm or less.

The material of the circumferential wall 41 is not particularly limited, and a known material of the bell mouth 40 may be used. Examples of the known material of the bell mouth 40 include plastic, ceramic, metal, and the like. In particular, resin is preferred since the weight can be reduced while maintaining strength.

As shown in FIGS. 1 and 2, the circumferential wall 41 of the bell mouth 40 includes four pressure changing component permeable portions 50 at predetermined intervals in the circumferential direction. In FIG. 1, the cross section of each pressure changing component permeable portion 50 is shaded for convenience. The pressure changing component permeable portion 50 will be described in detail later.

As shown in FIG. 1, when the bell mouth 40 is accommodated in the case 20, a predetermined gap L1 is provided parallel to the axis D of the bell mouth 40 between the inlet portion 41*c* of the bell mouth 40 and the bottom wall 21 of the case 20.

As shown in FIG. 1, in a direction orthogonal to the axis D, a predetermined gap is provided between the outer circumference of the bell mouth 40 and the case 20. In other words, the fan unit 10 includes open space extending between the outer circumference of the bell mouth 40 and the side walls 22 of the case 20. The open space functions as an air layer S. The air layer S is not particularly limited in size. However, a maximum distance L2 from the side wall 22 of the case 20 to the circumferential wall 41 is preferably 1 cm or greater, and more preferably, 3 cm or greater. In FIG. 1, the maximum distance L2 from the side wall 22 of the case 20 to the circumferential wall 41 indicates the distance from the side wall 22 of the case 20 to the tubular portion 41*b* of the bell mouth 40.

Pressure Changing Component Permeable Portion

The pressure changing component permeable portion 50 will now be described with reference to FIG. 2.

Four pressure changing component permeable portions 50 are arranged in the circumferential wall 41 of the bell mouth 40 at predetermined intervals in the circumferential direction. The pressure changing component permeable portions 50 are arranged at equal intervals. The pressure changing component permeable portions 50 are arranged in the tubular portion 41*b* of the circumferential wall 41, and extend over part of the outlet portion 41*a* and part of the inlet portion 41*c*.

Each pressure changing component permeable portion 50 is flush along the surface of the tubular portion 41*b*, the outlet portion 41*a*, and the inlet portion 41*c* of the circumferential wall 41. The thickness of the pressure changing component permeable portion 50 is substantially the same as the thickness of parts of the circumferential wall 41 other than the pressure changing component permeable portion 50.

The pressure changing component permeable portion 50 is formed by a porous body. The porous body extends through the circumferential wall 41 in the thickness direction. The porous body includes open pores connected to the outside. The open pores connect the opposite sides of the circumferential wall 41 in the thickness direction. The average pore diameter of the open pores is not particularly limited. However, the average pore diameter is preferably 1000 μm or less, and more preferably, 700 μm or less.

The method for measuring the average pore diameter is not particularly limited. For example, the average pore diameter can be measured through, for example, a gas adsorption method also referred to as a BET method.

The material of the pressure changing component permeable portion 50 is not particularly limited, and the material of a known porous body may be used. Examples of the known porous body material include plastic, ceramic, metal, and the like. Resin foam may be used as the plastic. A porous sintered body may be used as the ceramic or the metal. Further, a netted body also referred to as a mesh can be used as the metal. In particular, the porous sintered body is preferred because the average pore diameter can be readily adjusted.

As shown in FIG. 1, the separated distance L3 of the circumferential wall 41 of the bell mouth 40 from the axial fan 30 is minimal at the tubular portion 41*b*. The separated distance L3 from the axial fan 30 indicates the distance between the blades 32 of the axial fan 30 and the circumferential wall 41 of the bell mouth 40 in a direction orthogonal to the axial direction of the axial fan 30. The pressure changing component permeable portions 50 are arranged in the tubular portion 41*b* of the bell mouth 40. Thus, the pressure changing component permeable portions 50 are provided in the circumferential wall 41 at a location where the separated distance L3 from the axial fan 30 is minimal.

In FIG. 1, the axial direction of the axial fan 30 corresponds to the direction in which the axis D of the bell mouth 40 extends.

The arrangement of the pressure changing component permeable portions 50 in the circumferential wall 41 of the bell mouth 40 is not particularly limited. For example, the pressure changing component permeable portions 50 are formed having predetermined shapes. Further, the bell mouth 40 is formed with openings in the circumferential wall 41 for fitting the pressure changing component permeable portions 50. Then, the pressure changing component permeable portions 50 are fitted into the openings of the circumferential wall 41 of the bell mouth 40. This arranges the pressure changing component permeable portions 50 in the circumferential wall 41 of the bell mouth 40. Further, the pressure changing component permeable portions 50 may be bonded to the circumferential wall 41 of the bell mouth 40 with a known adhesive.

Figure 3:
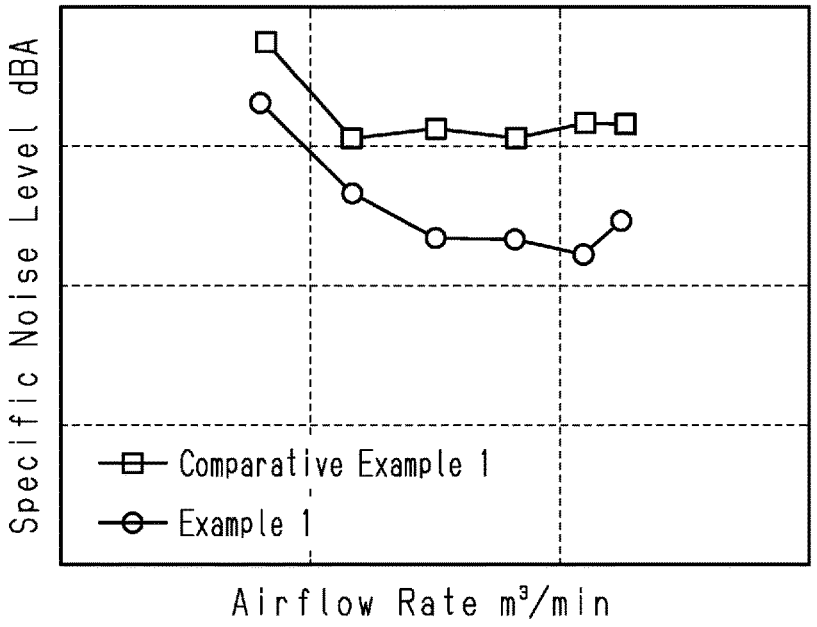
FIG. 3 is a graph showing the comparison result of the characteristics of Example 1 and the characteristics of Comparative Example 1.

FIG. 3 is a graph illustrating the comparison result of the characteristics of Example 1, which is the embodiment, and the characteristics of Comparative Example 1. Comparative Example 1 is a bell mouth that does not include the pressure changing component permeable portions 50. The bell mouth 40 of Example 1 includes the pressure changing component permeable portions 50 shown in FIG. 2. The pressure changing component permeable portions 50 are formed by a porous sintered body having an average pore diameter of 100 μm.

FIG. 3 shows the magnitude of the airflow noise with respect to the airflow rate at a bell mouth surface. As shown in FIG. 3, in the bell mouth 40 of Example 1, the airflow noise was reduced in all of the measured airflow rate ranges.

Figure 4:
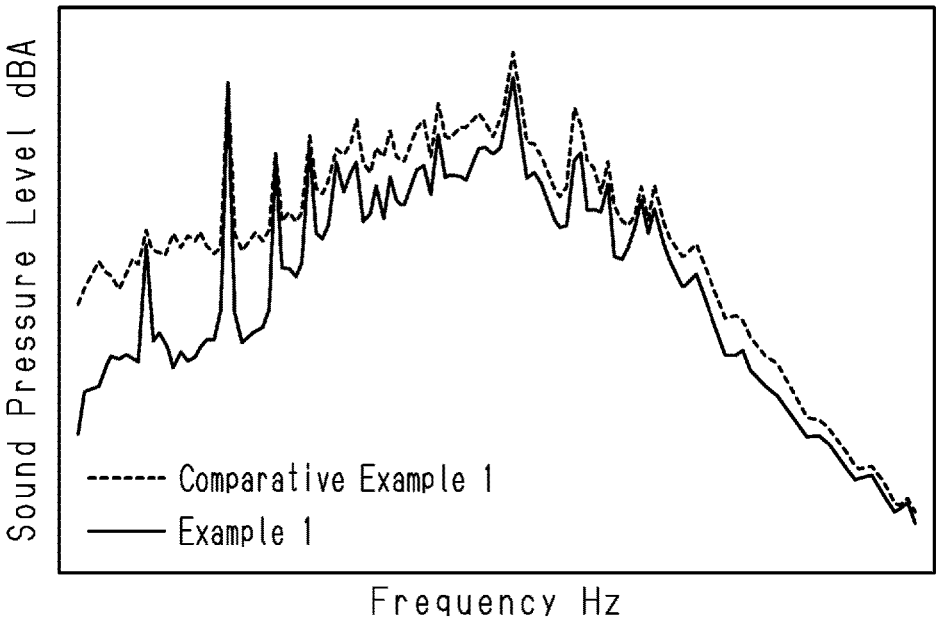
FIG. 4 is a graph showing the comparison result of the characteristics of Example 1 and the characteristics of Comparative Example 1.

FIG. 4 is a graph illustrating the comparison result of the characteristics of Example 1 and the characteristics of Comparative Example 1.

FIG. 4 shows the magnitude of the airflow noise with respect to frequency. In FIG. 4, the peaks of a sound pressure level are caused by NZ noise, and parts other than the peaks are caused by wind noise at the surface of the bell mouth.

As shown in FIG. 4, the sound pressure level of the bell mouth 40 of Example 1 was lower in all frequency ranges than Comparative Example 1. In addition, there were no significant differences in the heights of the peaks caused by the NZ noise between the bell mouth of Comparative Example 1 and the bell mouth 40 of Example 1. Thus, the bell mouth 40 of Example 1 reduced the wind noise at the surface of the bell mouth 40 in a preferred manner, but had a small NZ noise reducing effect.

Operation and Advantages

The operation of the present embodiment will now be described.

The bell mouth 40 of the present embodiment includes the pressure changing component permeable portions 50 in the circumferential wall 41 at a location where the separated distance L3 from the axial fan 30 is minimal. Thus, when the pressure changes in the air passing by the axial fan 30, the air readily passes through the pressure changing component permeable portions 50. In other words, when the pressure of air changes, the air can be released quickly through the pressure changing component permeable portions 50. This limits pressure changes in the vicinity of the circumferential wall 41, thereby mitigating surface vortices generated at the circumferential wall 41.

Further, the fan unit 10 of the present embodiment includes the air layer S between the outer circumference of the bell mouth 40 and the side walls 22 of the case 20. This allows the air passing through the pressure changing component permeable portions 50 to be readily released into the air layer S. Thus, surface vortices generated at the circumferential wall 41 of the bell mouth 40 are further efficiently mitigated.

The present embodiment has the following advantages.

(1) The bell mouth 40 of the present embodiment includes the pressure changing component permeable portions 50 in the circumferential wall 41 at a location where the separated distance L3 from the axial fan 30 is minimal.

With this structure, when the pressure changes in the air passing by the axial fan 30, the air in the vicinity of the circumferential wall 41 readily passes through the pressure changing component permeable portions 50. Thus, the change in pressure is reduced. This mitigates surface vortices generated on the circumferential wall 41 and suitably reduces wind noise caused by the surface vortices.

(2) The pressure changing component permeable portions 50 include pores connecting the opposite sides of the circumferential wall 41 in the thickness direction. The pores have an average pore diameter of 1000 μm or less.

When the pressure changes, this structure allows the air in the vicinity of the circumferential wall 41 to pass through the pressure changing component permeable portions 50, and excessive air does not pass through the pressure changing component permeable portions 50. This reduces loss in the air that passes through the axial fan 30 and is blown out from the outlet.

(3) The pressure changing component permeable portions 50 include pores connecting the opposite sides of the circumferential wall 41 in the thickness direction. The pores have an average pore diameter of 700 μm or less.

This structure allows the air in the vicinity of the circumferential wall 41 to pass through the pressure changing component permeable portions 50, and further reduces loss in the air that passes through the axial fan 30 and is blown out from the outlet.

(4) The pressure changing component permeable portions 50 are arranged at intervals in the circumferential direction of the circumferential wall 41.

This structure allows for the arrangement of the pressure changing component permeable portions 50, while maintaining the strength of the bell mouth 40 in a preferred manner.

(5) The thickness of the circumferential wall 41 is 1 mm or greater.

This structure ensures that air passes through the pressure changing component permeable portions 50 over a flow path length. Thus, a function for allowing for the permeable of the air in the vicinity of the circumferential wall 41 through the pressure changing component permeable portions 50 and a function for limiting the permeable of excessive air through the pressure changing component permeable portions 50 are both obtained.

(6) The thickness of the circumferential wall 41 is 10 mm or less.

With this structure, the thickness of the circumferential wall 41 is relatively thin. Thus, the cost for manufacturing the bell mouth 40 is reduced. In a fan shroud of the related art, NZ noise is reduced by absorbing impulsive noise of the flowing air with a through-pore material. Thus, the circumferential wall needs to be thick. In contrast, the bell mouth 40 of the present embodiment releases air, when the pressure changes, through the pressure changing component permeable portions 50. This allows the thickness of the circumferential wall to be reduced.

(7) The fan unit 10 includes the axial fan 30, the bell mouth 40, and the case 20, which accommodates the axial fan 30 and the bell mouth 40. Further, the air layer S extends between the circumferential wall 41 of the bell mouth 40 and the case 20.

With this structure, air that has passed through the pressure changing component permeable portions 50 is released to the air layer S. This readily reduces pressure changes in the pressure changing component permeable portions 50.

Modifications

In addition to the above embodiment, the bell mouth 40 and the fan unit 10 of the present disclosure may be in the form of, for example, the modifications described below and a combination of at least two modifications that do not contradict each other.

In the present embodiment, the four pressure changing component permeable portions 50 are arranged in the circumferential wall 41 of the bell mouth 40 at equal intervals in the circumferential direction. However, this structure may be modified. The quantity of the pressure changing component permeable portions 50 may be three or less or may be five or greater. The pressure changing component permeable portions 50 may be arranged at random intervals.

Figure 5:
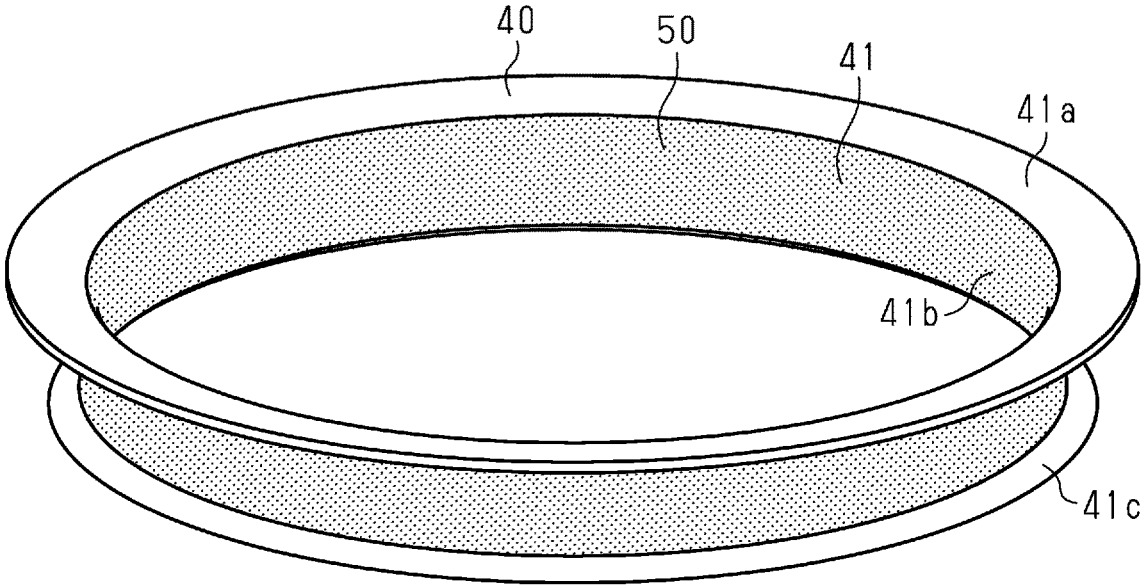
FIG. 5 is a perspective view of a bell mouth in a modified example.

As shown in FIG. 5, the pressure changing component permeable portion 50 may be arranged over the entire circumferential wall 41 of the bell mouth 40. Further, the circumferential wall 41 of the bell mouth 40 may be entirely formed by the pressure changing component permeable portion 50.

In the present embodiment, the pressure changing component permeable portions 50 are arranged in the tubular portion 41*b* of the circumferential wall 41, and extend over part of the outlet portion 41*a* and part of the inlet portion 41*c*. However, this structure may be modified. The pressure changing component permeable portions 50 may be arranged in only the tubular portion 41*b* of the circumferential wall 41.

In the present embodiment, the circumferential wall 41 of the bell mouth 40 includes the outlet portion 41*a*, the tubular portion 41*b*, and the inlet portion 41*c* but is not limited to such a structure. The circumferential wall 41 of the bell mouth 40 does not need to include the tubular portion 41*b*. In the circumferential wall 41 of the bell mouth 40, the outlet portion 41*a* and the inlet portion 41*c* may be formed continuously.

In the present embodiment, the porous body forming the pressure changing component permeable portions 50 is not limited to resin foam or a porous sintered body. The pressure changing component permeable portions 50 may each be a porous body including multiple through-holes that extend in one direction. For example, the porous body including multiple through-holes that extend in one direction can be formed by repeatedly inserting a needle member into a solid plastic body in one direction.

While the bell mouth 40 and the fan unit 10 according to the embodiment have been described, it will be understood that various changes in form and detail may be made without departing from the spirit and scope of the bell mouth 40 and the fan unit 10 described in the claims.

What is claimed is:

1. A bell mouth, comprising:

a circumferential wall; and a pressure changing component permeable portion arranged in the circumferential wall at a location where the circumferential wall laterally overlaps with a distal end of a blade of an axial fan; and an inlet portion configured to form a predetermined gap partially exposing an outer circumferential portion of the axial fan along an axis of the bell mouth between the inlet portion and a bottom wall of a case when the bell mouth is accommodated in the case.

2. The bell mouth according to claim 1, wherein the pressure changing component permeable portion includes pores connecting opposite sides of the circumferential wall in a thickness direction, and the pores have an average pore diameter of 1000 μm or less.

3. The bell mouth according to claim 1, wherein the pressure changing component permeable portion includes pores connecting opposite sides of the circumferential wall in a thickness direction, and the pores have an average pore diameter of 700 μm or less.

4. The bell mouth according to claim 1, wherein the pressure changing component permeable portion is one of multiple pressure changing component permeable portions arranged at intervals in a circumferential direction of the circumferential wall.

5. The bell mouth according to claim 1, wherein the circumferential wall has a thickness of 1 mm or greater.

6. The bell mouth according to claim 1, wherein the circumferential wall has a thickness of 10 mm or less.

7. A fan unit including the bell mouth according to claim 1, the fan unit further comprising:

an axial fan; and a case that accommodates the axial fan and the bell mouth, the fan unit having an air layer between the circumferential wall of the bell mouth and the case, the air layer being in communication with the predetermined gap.

8. The bell mouth according to claim 4, wherein the circumferential wall has a thickness of 1 mm or greater.

9. The bell mouth according to claim 4, wherein the circumferential wall has a thickness of 10 mm or less.

10. A fan unit including the bell mouth according to claim 4, the fan unit further comprising:

an axial fan; and a case that accommodates the axial fan and the bell mouth, the fan unit having an air layer between the circumferential wall of the bell mouth and the case, the air layer being in communication with the predetermined gap.

11. The bell mouth according to claim 5, wherein the circumferential wall has a thickness of 10 mm or less.

12. A fan unit including the bell mouth according to claim 5, the fan unit further comprising:

an axial fan; and a case that accommodates the axial fan and the bell mouth, the fan unit having an air layer between the circumferential wall of the bell mouth and the case, the air layer being in communication with the predetermined gap.

13. A fan unit including the bell mouth according to claim 6, the fan unit further comprising:

an axial fan; and a case that accommodates the axial fan and the bell mouth, the fan unit having an air layer between the circumferential wall of the bell mouth and the case, the air layer being in communication with the predetermined gap.

* * * * *